US006383420B1

(12) United States Patent
Mohr

(10) Patent No.: US 6,383,420 B1
(45) Date of Patent: May 7, 2002

(54) METHOD FOR THE VARIABLE MANUFACTURE OF CONCRETE RAILROAD TIES

(75) Inventor: Winfried Mohr, Neumarkt (DE)

(73) Assignee: Pfleiderer Infrastrukturkturtechnik GmbH, Neumarkt (DE)

( * ) Notice: Subject to any disclaimer, the term of this patent is extended or adjusted under 35 U.S.C. 154(b) by 0 days.

(21) Appl. No.: 09/371,698

(22) Filed: Aug. 10, 1999

(30) Foreign Application Priority Data

Aug. 11, 1998 (DE) ..... 198 36 320

(51) Int. Cl.[7] ..... B28B 7/04; B28B 5/00

(52) U.S. Cl. ..... 264/39; 264/40.1; 264/228; 264/229; 264/234

(58) Field of Search ..... 264/39, 69, 71, 264/228, 229, 234

(56) References Cited

U.S. PATENT DOCUMENTS 3,577,610 A * 5/1971 Margolin et al.

4,409,159 A * 10/1983 Parkins ..... 264/39

* cited by examiner

*Primary Examiner*—Christopher A. Fiorilla

(74) *Attorney, Agent, or Firm*—Jordan and Hamburg LLP

(57) ABSTRACT

A method for a variable manufacture of concrete railroad ties, with or without prestressed reinforcement, is provided wherein molds are cleaned in a preparation station and provided with the reinforcements, and are subsequently filled with concrete in a concreting and shaking station. Then the railroad ties are cured by a heat treatment. All railroad ties are produced in multiple molds, preferably in quadruple molds having identical dimensions, and the heat treatment is carried out in heating chambers. The heating chambers are loaded and unloaded with the concrete-filled molds by means of a shelf servicing device, which also supplies the molds to a stress relieving and emptying station which leads to the preparation station. Furthere provided is an apparatus for implementing this method.

8 Claims, 1 Drawing Sheet

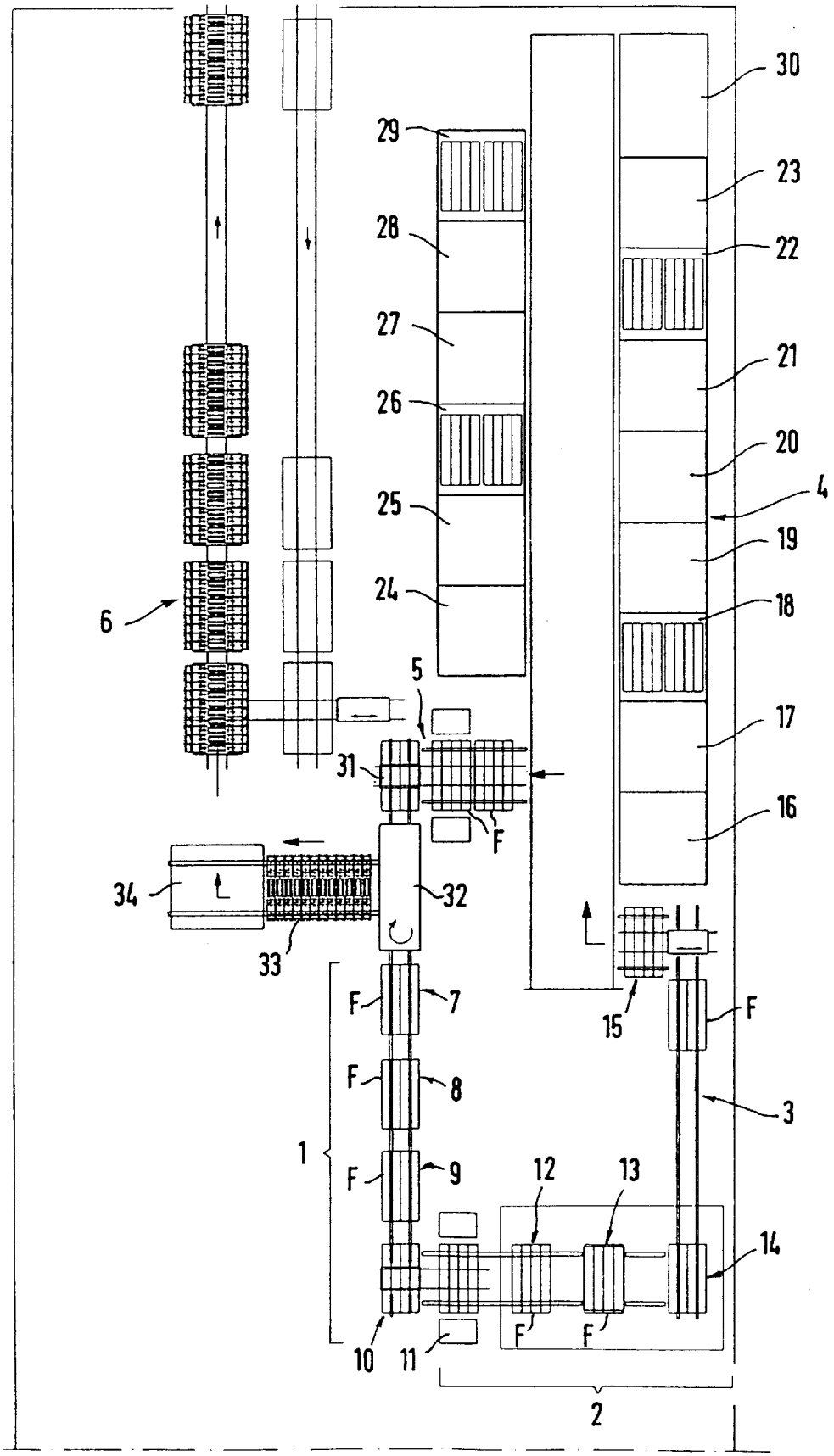
30
29
23
28
22
27
21
26
20
4
25
19
24
18
6
5
17
31
16
F
34
32
33
F
7
15
F
F
8
3
1
F
9
12
13
14
10
11
F
F
2

METHOD FOR THE VARIABLE MANUFACTURE OF CONCRETE RAILROAD TIES

BACKGROUND OF THE INVENTION

The invention relates to a method for variable manufacture of concrete railroad ties with or without prestressed reinforcement, for which molds are cleaned in a preparation station and provided with reinforcements, in order subsequently to be filled with concrete in a concreting and shaking station, and the railroad ties are cured by a heat treatment, and to an apparatus for carrying out this method.

Prestressed reinforced concrete railroad ties or non-prestressed reinforced railroad ties are manufactured worldwide by several methods. At the present time, especially four systems are used.

In the case of an immediate removal of formwork with a subsequent stressing process, the railroad ties are produced in a mold with holes, in which prestressing steel is subsequently inserted and stressed by means of nuts, that are left open in the molds by die plates. The railroad ties are cured in heating chambers, after the formwork is removed from the railroad ties and only concrete objects are placed into the heating chambers.

For the manufacture of prestressed concrete railroad ties with direct connection, there are several common methods, such as a late removal of formwork method using a long clamping bed, a late removal of formwork method using a short clamping bed in a circulating method, and a late removal of formwork in the circulating method. For the first two methods, long blocks of reinforced concrete railroad ties, which hang together, must be sawn apart. On the other hand, in the case of the late removal of formwork in the circulating method, the individual railroad ties are next to one another in multiple molds. In the case of the late removal of formwork method using the long clamping bed as well as using the short clamping bed, which can be realized only in large stationary plants because of the appreciable dimensions of the molds of between about 15 and 150 meters, curing creates difficulties, since it can be brought about only partly under sheets placed down or by means of a cumbersome transport of the very long molds into a heating chamber. For the late removal of the formwork in the circulating method, the multiple molds are transported into a heating chamber tunnel. This type of curing in heating chamber tunnels with a fixed passage cycle has the disadvantage that similar types of railroad ties with different curing times cannot meaningfully be manufactured in the same passage.

SUMMARY OF THE INVENTION

It is therefore an object of the invention to create a method and an apparatus for variable manufacture of concrete railroad ties with and without prestressed reinforcement, with which it is possible to produce different types of railroad ties, with or without prestressed reinforcement, in the same plant in the same production cycle.

Pursuant to the invention, this objective is accomplished by producing all railroad ties in multiple molds, preferably in quadruple molds having identical external dimensions, and carrying out heat treatment in heating chambers, which are loaded and unloaded with the concrete-filled molds by means of a shelf servicing device, which supplies the molds to a stress relieving and emptying station ahead of a preparation station.

Pursuant to the invention therefore, working with large molds in a short clamping bed or a long clamping bed is omitted. Instead, basically all concrete railroad ties are produced in multiple molds using individual molds, which are disposed next to one another and are intended to be put under tension individually. This has the additional advantage that alternately the reinforcement can be omitted in individual molds and even in individual molds within a multiple mold, so that, for example, reinforced railroad ties as well as railroad ties, which are not reinforced, can be produced within a multiple mold, such as a quadruple mold.

In a further development of the invention, the different concrete railroad ties are produced in multiple molds, which consist of a load-bearing frame and an exchangeably inserted inlay shaped plate This construction results in a standard dimension for the external frame, which enables the heating chambers to be subdivided in a standard fashion in a particularly advantageous manner to correspond to this frame size. This, in turn, permits very different railroad ties to be manufactured in a continuous method with different curing times and different temperatures in the heating chambers by means of a computer-controlled shelf servicing device. Moreover, retrofitting multiple molds for different concrete railroad ties is extremely simple, in that only the installed inlay shaped plate can be exchanged. In addition, the possibility also arises in this manner of being able to produce different concrete railroad ties simultaneously within a multiple mold.

For carrying out the method, a circulating production plant is used, for which a preparation station for empty molds is followed by a concreting and shaking station with a transfer transport segment to a shelf servicing device of a curing station, which has a plurality of heating chambers and is followed by an emptying station containing a stress-relieving station, and a buffer segment for the molds preferably being disposed downstream from each station.

The plant of the present invention can be designed as a mobile plant and have components and capacity adapted depending on requirements. The plant can be built in container units, which only have to be connected electrically and for which expensive crane equipment is not required, since the transport of the molds from and to the curing equipment can be designed very simply as a result of the convenient multiple molds used, which preferably should be quadruple molds.

By using a plurality of separated heating chamber segments, a mixed production of prestressed concrete railroad ties and non-stressed reinforced railroad ties is possible. It should be noted here that the prestressed concrete railroad ties require a longer curing time. The non-stressed reinforced railroad tie molds can therefore be used twice a day. The computer-controlled shelf servicing device places reinforced concrete railroad ties and non-stressed reinforced railroad ties separately in the heating chambers and transports the cured railroad ties, as desired, for removal of formwork. The total plant requires only little space in relation to conventional late formwork removing systems. At the same time, there is yet the advantage that the molds of the plant can also be used in other plants with different production methods.

The method and the apparatus of the present invention furthermore also have the advantage that accessories for solid tracks and wide railroad tie tracks, such as sound absorbers or filling stones, also can be produced therewith and, moreover, once again in the same continuous method, merely by using other molds. The differences between these accessories and prestressed concrete railroad ties or reinforced railroad ties, especially with respect to temperature and curing time, can be collected and taken into consideration appropriately fully automatically by means of the programmed shelf servicing device.

Further advantages, distinguishing features and details of the present invention arise out of the following description of an example by means of the accompanying drawing.

IN THE DRAWING

The accompanying single sheet drawing diagrammatically shows the construction of an inventive production plant.

DESCRIPTION OF THE PREFERRED EMBODIMENTS

The plant comprises a preparation station 1, a concreting and shaking station 2, with a transfer transporting segment 3 to shelf servicing device of a curing station 4 having a plurality of heating chambers, and an emptying or stress relieving station 5. In addition, a stacking station 6 is located preferably in a vicinity of this manufacturing station.

Emptied molds, used in a previous production cycle, are prepared once again in a cleaning and oiling station 7 and supplied over a buffer 8 to a complete mold preparation station 9, which is connected to a buffer station 10. In a subsequent stressing station 11, an inserted reinforcement is put under tension, if required, and the molds, after passing through a further buffer 12, are filled with concrete in a shaking frame 13 and shaken. By way of an additional buffer station 14, the molds are passed over the transfer transport segment 3 to a receiving station 15, from which they are taken over by a shelf servicing device of the curing station 4, which is not shown, and placed into individual chambers 16 to 29.

An essential special feature of the method and, with that, also of the construction of the apparatus for this method is the fact that, from the very start, exclusively identical multiple molds are processed, the word "identical" meaning that they have the same external dimensions, while an inner subdivision is selected, of course, in accordance with different types of railroad ties, which are to be produced. Preferably, this is facilitated because the multiple molds consist of a load-bearing frame and an exchangeable, inserted inlay shaped plate. Due to this use of similar multiple molds, the curing station 4 can be divided correspondingly into chambers 16 to 29, the width and depth of which are selected to correspond to the dimensions of the multiple molds. Of course, a plurality of such molds can be introduced on top of one another in appropriate slide-in units. The computer-controlled shelf servicing device computer room 30 also contains the control equipment for the heating chambers 16 to 29 and uses necessary information regarding the individual molds provided directly via an input station at the concreting and shaking station 13. On the other hand, appropriate markings or identifying chips can also be provided at the molds and be read over a reading station of the shelf servicing device 30. The shelf servicing device 30 then deposits the multiple molds, identified by it, somewhere in the heating chambers 16–29 and, even in the case of a chaotic deposit, can always have access in a suitable manner in order to remove the multiple mold once again after the specified curing time of the railroad ties and deposit it in the emptying station 5 containing a stress-relieving station. After the stresses are relieved or the railroad ties emptied or if railroad tie absorbers, filling stones or the like are to be produced, the molds are supplied over a buffer station 31 to a manipulator 32, which rotates the mold and deposits the railroad tie on a conveyor belt, with which they are transported through an installation station 33. The emptied molds are deposited on a different conveyor belt, which supplies them to the cleaning and oiling station 7 of the preparation station 1. Rail attachments are installed on the conveyor belt of the installation station. A lifting and turning device 34, which may be required, stacks the railroad ties in specified units, so that a crane in the storage area can load railroad tie packages of equal size. If necessary, however, a long chain or roll conveyor can also convey the railroad ties to the storage area, that is, for example, to the stacking station 6 that has been shown.

What is claimed is:

1. A method for variable manufacture of concrete railroad ties, comprising:

providing a plurality of molds, each of the molds being a multiple mold;

serially cleaning the molds in a preparation station;

serially providing at least one of the plurality molds with prestressed reinforcement at a stressing station while leaving at least one of the plurality molds without a prestressed reinforcement;

serially filling the plurality of molds with concrete in a concreting and shaking station to form the railroad ties;

serially loading the plurality of molds, including the at least one of the molds having a prestressed reinforcement and the at least one of the molds without a prestressed reinforcement, filled with concrete respectively into any ones of a plurality of individual heating chambers in a common curing station;

curing the railroad ties by exposure to at least a first heat treatment for the at least one of the molds having a prestressed reinforcement in a corresponding at least one of the individual heating chambers and exposure to at least a second heat treatment for curing the at least one of the molds without a prestressed reinforcement in a corresponding at least one of the heating chambers including, the curing including:

individually monitoring respective curing times of the first heat treatment and the second heat treatment of the plurality of molds in the respective ones of the plurality of individual heating chambers, including the at least one of the molds having a prestressed reinforcement and the at least one of the molds without a prestressed reinforcement; and serially unloading the plurality of molds from the individual heat chambers after respective ones of the curing times of the first heat treatment and the second heat treatment have passed; and serially transferring the plurality of molds to a stress relieving and emptying station located ahead of the preparation station after respective ones of the plurality of molds have completed curing and have been unloaded.

2. The method according to claim 1, wherein the multiple molds are quadruple molds having substantially identical external dimensions.

3. The method according to claim 1, wherein the said steps of loading and unloading utilize a shelf servicing device as a common loading device.

4. The method according to claim 1, wherein the multiple molds each comprises a load-bearing frame and an exchangeable, inserted inlay shaped plate.

5. The method according to claim 1, wherein the step of curing includes the first and second heat treatment having different periods of time and at different temperatures and the individual heating chambers being independently controllable.

6. The method according to claim 1, wherein the said steps of loading and unloading the heating chambers utilize a common loading device.

7. The method according to claim 1, wherein the steps of the said steps of loading and unloading the heating chambers and the step of monitoring are effected using a computer to individual track the at least one of the molds having a prestressed reinforcement and the at least one of the molds without a prestressed reinforcement by controlling the loading of the individual heating chamber, the monitoring of the curing times, and the unloading of the plurality of molds.

8. The method according to claim 7, wherein the said steps of loading and unloading the heating chambers utilize a common loading device.

* * * * *

UNITED STATES PATENT AND TRADEMARK OFFICE

CERTIFICATE OF CORRECTION

PATENT NO. : 6,383,420 B1
DATED : May 7, 2002
INVENTOR(S) : Winfried Mohr

It is certified that error appears in the above-identified patent and that said Letters Patent is hereby corrected as shown below:

Title page,
Item [54], please correct the title from
"[54] METHOD FOR THE VARIABLE MANUFACTURE OF CONCRETE RAILDROAD TIES" to -- [54] METHOD AND APPARATUS FOR THE VARIABLE MANUFACTURE OF CONCRETE RAILROAD TIES --.

Signed and Sealed this

Twenty-fourth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,383,420 B1
DATED : May 7, 2002
INVENTOR(S) : Winfried Mohr

It is certified that error appears in the above-identified patent and that said Letters Patent is hereby corrected as shown below:

Title page,
Item [73], please correct the name of the Assignee from:
"[73] Pfleiderer Infrastrukturkturtechnik GmbH, Neumarkt (DE)" to
-- [73] Pfleiderer Infrastrukturtechnik GmbH, Neumarkt (DE) --.

Signed and Sealed this

Twenty-fifth Day of March, 2003

JAMES E. ROGAN
*Director of the United States Patent and Trademark Office*